US005509366A

United States Patent [19]

Wokeck

[11] Patent Number: 5,509,366

[45] Date of Patent: Apr. 23, 1996

[54] PULLER APPARATUS

[75] Inventor: Arthur C. Wokeck, Mauldin, S.C.

[73] Assignee: Clinton Industries, Inc., Carlstadt, N.J.

[21] Appl. No.: 234,829

[22] Filed: Apr. 28, 1994

[51] Int. Cl.[6] ..... D05B 27/10

[52] U.S. Cl. ..... 112/318; 112/235; 112/319

[58] Field of Search ..... 112/322, 318, 112/320, 235, 307, 319; 226/124, 158, 159

[56] References Cited

U.S. PATENT DOCUMENTS

| | | | |
|---|---|---|---|
| 1,828,722 | 10/1931 | Sailer | 112/235 X |
| 1,852,482 | 4/1932 | Seavers et al. | 112/235 |
| 2,481,286 | 9/1949 | Bouwkamp | 112/235 |
| 2,611,333 | 9/1952 | Ritter | 112/235 |
| 2,687,704 | 8/1954 | Galkin | 112/318 |

OTHER PUBLICATIONS

PFAFF 5642 Service Manual & List of spare parts Pfaff, D–6750 Kaiserslautern, Postfach 3020/3040.

*Primary Examiner*—Paul C. Lewis

*Attorney, Agent, or Firm*—Darby & Darby

[57] ABSTRACT

A puller device of a sewing machine having a stitch-forming mechanism alternately engageable and disengageable with a garment for stitching the garment and a feed mechanism for feeding the garment through the stitch-forming mechanism. The puller device comprises a puller roller downstream of the feed mechanism for uniformly pulling the garment when the stitch-forming mechanism is disengaged from the garment. The puller device also comprises a feed rocker shaft, clampingly-attached to the feed mechanism, for driving the puller roller in synchronization with the stitch-forming mechanism, intermittently engaging the puller roller when the stitch-forming mechanism is disengaged from the garment and intermittently disengaging the puller roller when the stitch-forming mechanism is engaged with the garment. The puller device includes first and second presser feet positioned adjacent the puller roller for urging the garment against the puller roller. First and second pneumatic cylinders are operatively connected to the first and second presser feet, respectively, for selectively and independently moving the first and second presser feet into and out of engagement with different thicknesses of the garment.

23 Claims, 2 Drawing Sheets

PULLER APPARATUS

FIELD OF THE INVENTION

This invention relates in general to a puller device for use with a sewing machine, and more particularly to a puller device having multiple presser feet for engaging a variable thickness garment having adjacent portions, at least one of which has multiple layers of fabric, wherein each presser foot independently engages an adjacent portion for urging the garment against a rotating puller roller, thereby uniformly pulling the garment through the sewing machine so that excess threads may be cut from the garment.

BACKGROUND OF THE INVENTION

Sewing machine structures and garment feeding mechanisms have taken a variety of configurations over the years since their initial conception. Today, the general configuration of the sewing machine comprises a needle assembly, including a needle and presser foot, being driven by a shaft and a feed mechanism to move a garment past the needle assembly as it reciprocates. Traditionally, the feed mechanism takes the form of "feed dogs", i.e., elongated members located beneath the needle having serrated upper surfaces for engaging the garment and moving it toward the needle. The drive mechanism for the feed dogs is typically interconnected with the needle assembly drive mechanism so that the feed dogs do not push the garment while engaged with the needle.

This system, however, is unreliable when the material thickness of adjacent portions of a single garment varies greatly. This differs from a puller device that can accommodate varying thicknesses of different garments but where each individual garment has only one material thickness. For example, the commercial fabrication of heavy jean slacks requires a thirteen ply thickness to be sewn under one presser foot and a four ply thickness to be sewn under another presser foot, as opposed to the fabrication of a garment having a uniform thickness. Using traditional puller mechanisms, the puller rollers either slow down, stop completely or slip, causing the variable thickness garment to feed improperly.

The prior art discloses an upper and lower roller which engage a garment behind a single presser foot: U.S. Pat. No. 2,687,704, Galkin, issued Aug. 31, 1954; U.S. Pat. No. 2,706,457, Galkin, issued Apr. 19, 1995; U.S. Pat. No. 4,187,795, Norton, issued Feb. 12, 1980; U.S. Pat. No. 4,318,360, Uemura et al., issued Mar. 9, 1982. One of the rollers is driven so as to impart motion to the material, along with the feed dog, when the needle is withdrawn. The force of the presser foot on the material overcomes the driving force of the rollers during that portion of the operational cycle when the feed dog disengages the material. When the feed dog engages the material, thereby pushing it, the drive roller rotates to assist in the material feed. The prior art cannot properly accommodate a single garment having adjacent portions of variable thickness fabric since the upper and lower rollers would only engage the greatest fabric thickness while leaving the thinner fabric thickness to pass uncontrolled through the stitch-forming mechanism. None of the aforesaid patents disclose a device for uniformly feeding a single garment, wherein the material thickness of adjacent portions of the garment varies greatly.

The prior art also discloses a single roller positioned substantially below the sewing machine work surface and behind a single presser foot, U.S. Pat. No. 3,198,153, Weber, issued Aug. 3, 1965. Similarly, the prior art discloses a single roller positioned substantially above the sewing machine work surface and behind a single presser foot: U.S. Pat. No. 3,625,168, Palazzo, issued Dec. 7, 1971; U.S. Pat. No. 4,996,934, Lue, issued Mar. 5, 1991. None of these patent, however, disclose a puller device that can properly accommodate a single garment having adjacent portions of variable fabric.

Another deficiency of the prior art is the inability to cut excess threads from a variable thickness fabric after being moved by a roller. For example, U.S. Pat. No. 4,461,229, Angele, issued Jul. 24, 1984, discloses a roller that operates behind a needle assembly to pull a garment in order to cut thread from the garment. However, the puller wheel is positioned such that it interferes with the thread cutting process. In addition, the puller wheel is manually engaged by a lever, which further interferes with the cutting process. A puller device which allows excess threads to be cut from the garment without adjusting for the interference of the puller device is not disclosed. A solution would be to provide a puller roller positioned so as not to interfere with the thread cutting process.

Another deficiency of the aforesaid prior art is that the puller device is disclosed to be driven by the sewing machine motor. Therefore, any adjustment or repair of the puller device requires downtime of the sewing machine in order to adjust the puller roller's speed, maintain the puller roller support beatings or repair the puller device.

SUMMARY OF THE INVENTION

Accordingly, it is an object of the present invention to provide a puller device for use with a sewing machine that adjusts to a variable thickness garment having adjacent portions, at least one of which has multiple layers, for uniformly pulling the garment through a stitch-forming mechanism of the sewing machine for improved stitching and for moving the garment away from the stitch-forming mechanism, whereby excess threads may be cut from the garment.

It is a further object of the invention that the puller roller of the puller device be selectably movable to a position that will not interfere with the operation of the sewing machine or the thread cutting process.

It is a further object of the invention to provide a puller device for use with a sewing machine having a stitch-forming mechanism alternately engageable and disengageable with a garment for stitching the garment and a feed mechanism for feeding the garment through the stitch-forming mechanism when the stitch-forming mechanism is disengaged from the garment, comprising a puller roller positioned downstream of the feed mechanism for uniformly pulling the garment when the stitch-forming mechanism is disengaged from the garment, a drive mechanism clampingly attached to the feed mechanism for driving the puller roller in synchronization with the stitch-forming mechanism, intermittently engaging the puller roller for advancing the garment when the stitch-forming mechanism is disengaged from the garment, and intermittently disengaging the puller roller when the stitch-forming mechanism is engaged with the garment, first and second presser feet positioned adjacent the puller roller for urging the garment against the puller roller, and first and second control mechanisms operatively connected to the first and second presser feet, respectively, for selectively and independently moving the first and second presser feet into and out of engagement with first and second adjacent portions of the garment.

DETAILED DESCRIPTION OF THE INVENTION

Figure 1:
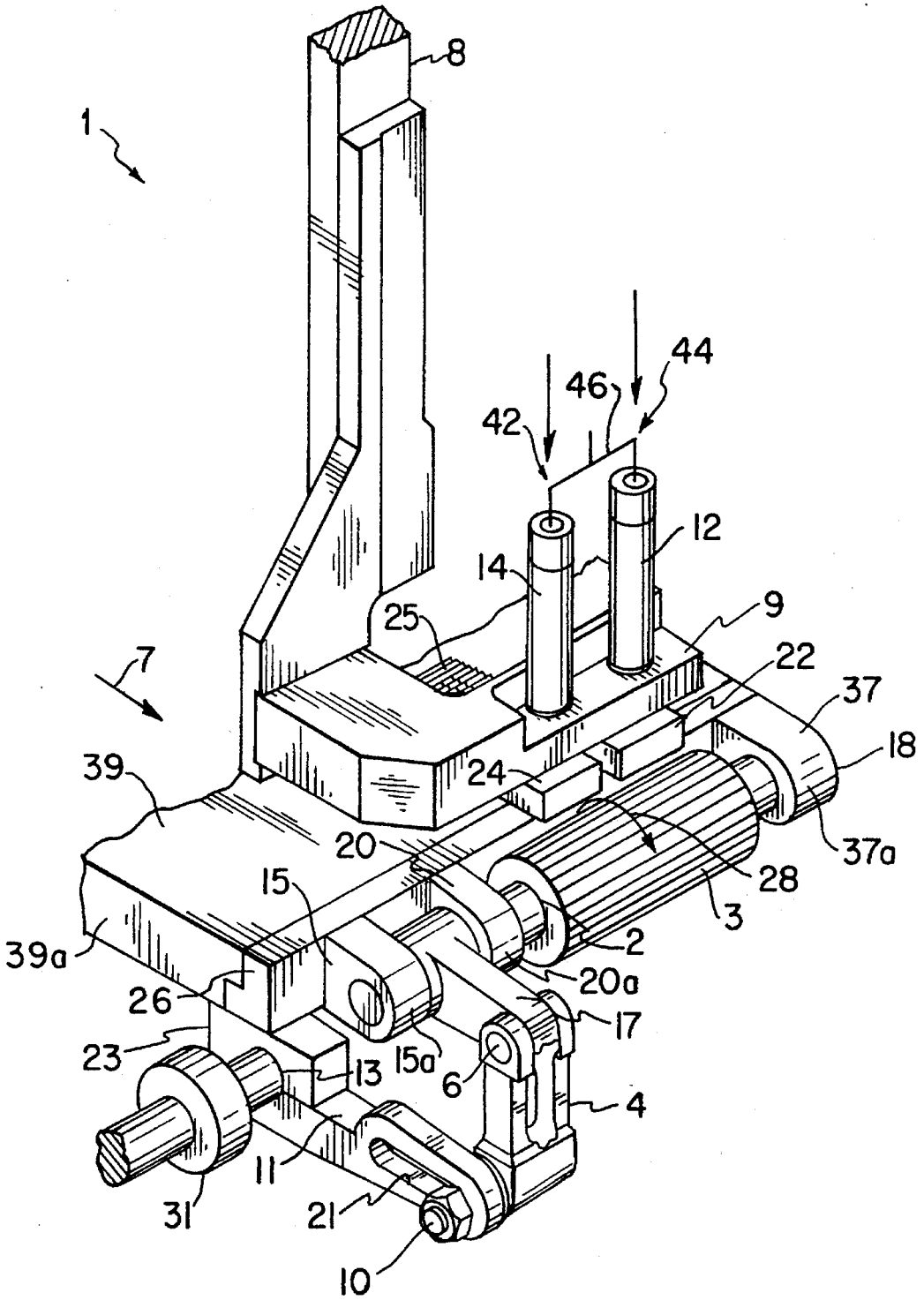
FIG. 1 is a perspective view of the puller device according to the present invention.
Figure 2:
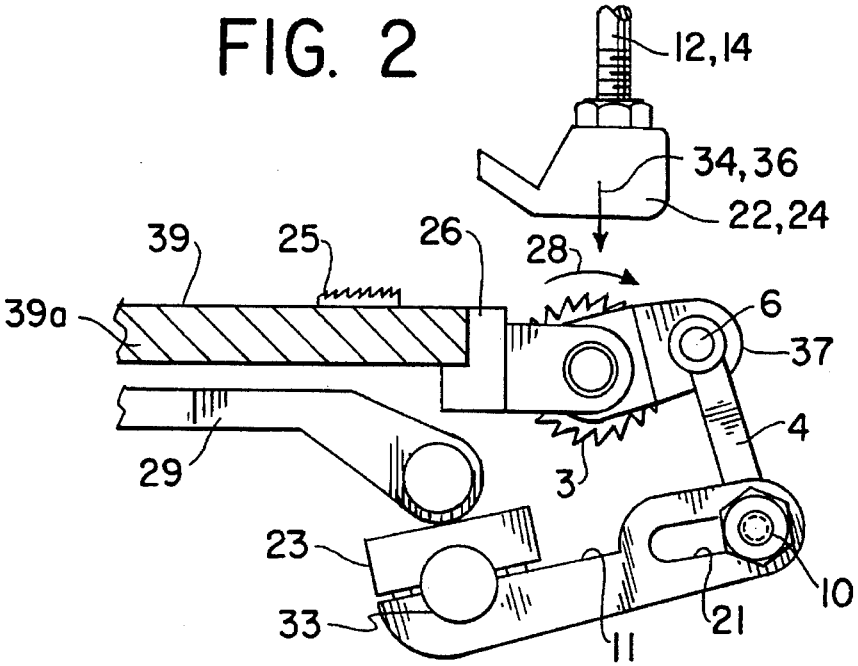
FIG. 2 is a side view of the puller roller and its drive linkage in relation to the compensating pressure feet in the preferred embodiment of the present invention.

Referring to FIGS. 1 and 2, a preferred puller device 1 having a stitch-forming needle assembly and a feed mechanism 25, comprises a puller roller 3, a drive shaft 33, and first and second presser feet 22, 24, controlled by first and second pneumatic cylinders 12, 14, respectively, to accommodate a variable thickness garment 5 having top and bottom surfaces 30, 32, respectively, and first and second adjacent portions 40, 41, respectively, at least one of which has multiple layers 44 (FIG. 3) sewn on a sewing machine 8. In the preferred embodiment, puller device 1 is attached to an industrial sewing machine 8 but may be attached to any sewing machine, conventional or industrial, without deviating from the intent of the invention.

The needle assembly and feed mechanism of puller device 1 comprise a conventional needle (not shown), positioned above a work surface 39, and a feed dog 25, operatively attached to work surface 39, respectively, as is well known in the art. The needle assembly engages garment 5 intermittently, for stitching garment 5 with conventional thread, as garment 5 is fed across work surface 39 of plate **39*a* by feed dog 25 in downstream direction 7 toward puller roller 3. Puller roller 3 is attached to plate 39*a* by mounting strip 26 and is thus positioned adjacent to feed mechanism 25, which advances garment 5 only when the needle assembly is disengaged from garment 5. Therefore, the needle assembly engages garment 5 when puller roller 3 is stationary and disengages garment 5 when puller roller 3** is rotating.

The preferred puller and drive mechanisms of puller device 1 comprise puller roller 3 and feed rocker shaft 33, respectively. Puller roller 3 has a serrated peripheral surface and a shaft 2 rotatably supported by spaced bearings 15, 20 and 37. A radially extending arm 17 is fixed to shaft 2 in the region between bearings 15, 20 for rocking movement of arm 17 in response to oscillating movement of feed rocker shaft 33. The bearings 15, 20 and 37 are located in spaced arms **15*a*, 20*a* and 37*a* extending laterally from and fixed to mounting strip 26. Feed rocker shaft 33 is clampingly attached, externally of sewing machine 8, to puller arm 11 through bore 13, which is formed by puller arm 11 and shaft pinch cap 23. The driving movement of feed rocker shaft 33 is transferred to roller 3 by arms 11, 4 and 17, respectively, wherein arm 11 is adjustably attached to arm 4 by engagement of pin 10 through slot 21 and arm 4 is lockingly attached to arm 17 by pin 6. Therefore, when feed rocker shaft 33 oscillates, arms 11, 4 and 17 oscillate in response, rotating roller 3, correspondingly, in direction 28 only, due to the action of a one-way ratchet 18. Ratchet 18 is housed within beating flange 37*a* and prevents puller roller 3 from rotating in a direction opposite to direction 28**, as is well known in the art.

Both feed dog 25 and puller roller 3 are driven by feed rocker shaft 33, which engages feed stroke 29 of sewing machine 8. Therefore, feed dog 25 and puller roller 3 move in synchronization with the needle assembly to intermittently advance garment 5. Attaching feed rocker shaft 33 to puller roller 3 externally of sewing machine 8 has significant advantages over conventional, internally driven puller devices, which require the entire sewing machine 8 to be shut down for repair of the drive mechanism and puller roller. In contrast, the preferred puller roller 3 is attached externally of sewing machine 8, thereby eliminating downtime of sewing machine 8 during routine maintenance and repair of puller device 1. In addition, driving puller roller 3 and feed dog 25 in synchronization with one another allows puller roller 3 to be "over-driven" (i.e. driven faster than feed dog 25) to assist feed dog 25 in uniformly feeding garment 5.

Puller device 1 also comprises first and second compensating presser feet 22, 24 for engaging top surface 30 of garment 5, controlled by first and second pneumatic cylinders 12, 14, respectively. Presser feet 22, 24 comprise treated surfaces adjacent to puller roller 3 in the preferred embodiment to expedite the movement of garment 5. Presser feet 22, 24 and pneumatic cylinders 12, 14 are mounted on bracket 9, which is lockingly attached to sewing machine 8. Mounting bracket 9 may be attached to sewing machine 8 in a variety of ways without deviating from the intent of the invention. In the preferred embodiment, the air supply provided to pneumatic cylinders 12, 14 is fed through individual air lines 42, 44 (FIG. 3), for individual control of presser feet 22, 24; however, the air supply could be combined into one air line 46 without deviating from the intent of the invention.

Figure 3:
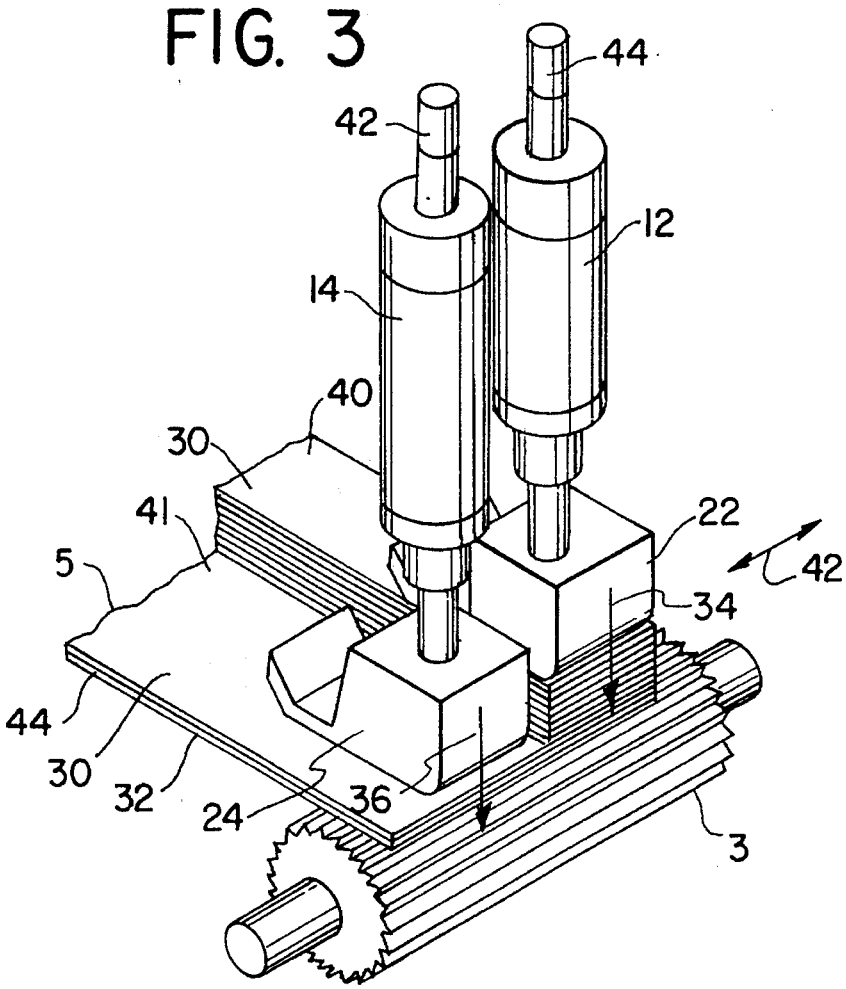
FIG. 3 is a perspective view of the compensating presser feet's motion in relation to the puller roller during engagement with the garment in the preferred embodiment of the present invention, wherein the variable thickness garment comprises first and second adjacent portions, at least one of which has multiple layers.

Referring to FIG. 3, pneumatic cylinders 12, 14 control the engagement of presser feet 22, 24 with garment 5 in a vertical direction 34, 36. Pneumatic cylinders 12, 14 may be activated individually or collectively to control the engagement of one or both presser feet, 22, 24, thereby accommodating first and second adjacent portions 40, 41, at least one of which has multiple layers. For illustration purposes only, portion 40 of FIG. 3 comprises six layers 44 and portion 41 comprises two layers 44 to simulate the fabric thickness in the commercial fabrication of jean slacks, which requires a larger layer thickness to be sewn under one presser foot 22 and a smaller layer thickness to be sewn under another presser foot 24. Presser feet 22, 24 may also be adjusted in a lateral direction 42 to further accommodate varying widths of first and second adjacent portions 40, 41 of garment 5 by threading the shafts of pneumatic cylinders 12, 14 to provide the adjustment capability.

In the preferred embodiment, presser feet 22, 24 engage garment 5 substantially above puller roller 3. Thus, upon activation of pneumatic cylinders 12, 14, presser feet 22, 24 engage top surface 30 of garment 5 while feed dog 25 and puller roller 3 engage bottom surface 32. When pneumatic cylinders 12, 14 are activated, presser feet 22, 24, urge bottom surface 32 of garment 5 against the serrated surface of rotating puller roller 3, thereby uniformly pulling garment 5 in a controlled path for improved stitching. Puller roller 3 moves intermittently as the needle assembly disengages top surface 30, thereby preventing needle breakage after stitching garment 5 with conventional thread. In addition, puller roller 3 pulls garment 5 uniformly, downstream of the stitch-forming mechanism, whereby excess thread may be cut from garment 5. An advantage resulting from this invention is that downtime of sewing machine 8 is reduced since the variable thickness portions 40, 41 of garment 5 are less likely to "bunch", as with conventional puller devices, as garment 5 is fed between presser feet 22, 24 and puller roller 3. Therefore, providing multiple presser feet 22, 24 in conjunction with puller roller 3 provides a solution to the problem of stitching adjacent portions 40, 41 of a variable thickness garment 5.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A puller device in combination with a sewing machine having a stitch-forming means that utilizes thread, alternately engageable and disengageable with a garment having portions of different thickness material and a feed means for feeding the garment through the stitch-forming means when the stitch-forming means is disengaged from the garment, comprising:

puller means downstream of the feed means for uniformly pulling the garment when the stitch-forming means is disengaged from the garment;

drive means for driving said puller means in synchronization with the stitch-forming means, said drive means intermittently driving said puller means for advancing the garment when the stitch-forming means is disengaged from the garment;

first and second engagement means positioned adjacent said puller means; and first and second control means operatively connected to said first and second engagement means for selectively moving said first and second engagement means into and out of engagement with the portions of different thickness material, respectively, of the garment, for urging the garment against said puller means when the stitch-forming means is disengaged from the garment.

2. The puller device of claim 1, wherein said puller device pulls the garment downstream of the stitch-forming means so that excess thread may be cut from the garment.

3. The puller device of claim 1, wherein the garment has a top surface and a bottom surface, said first and second engagement means engaging said top surface of the garment and said feed means and said puller means engaging said bottom surface of the garment.

4. The puller device of claim 1, wherein the variable thickness garment has first and second adjacent portions, at least one of which has multiple layers of fabric.

5. The puller device of claim 1, wherein said feed means comprises a feed dog.

6. The puller device of claim 1, wherein said puller means comprises a roller having a serrated peripheral surface.

7. The puller device of claim 1, wherein said puller means is attached externally of the sewing machine.

8. The puller device of claim 1, wherein said drive means is clampingly attached to said feed means.

9. The puller device of claim 1, wherein said drive means comprises a feed rocker shaft.

10. The puller device of claim 1, wherein said first and second engagement means comprise first and second presser feet, respectively.

11. The puller device of claim 1, wherein said first and second control means function independently of one another, thereby selectively moving said first and second engagement means, respectively, to accommodate said first and second adjacent portions, at least one of which has multiple layers.

12. The puller device of claim 1, wherein said first and second control means comprise first and second pneumatic cylinders, respectively.

13. The puller device of claim 1, wherein said first and second control means are laterally adjustable to further accommodate said first and second adjacent portions, at least one of which has multiple layers.

14. A puller device in combination with a sewing machine having a stitch-forming means, alternately engageable and disengageable with a variable thickness garment having first and second adjacent portions, at least one of which has multiple layers of fabric, and top and bottom surfaces of said first and second portions, wherein the stitch-forming means engages the top surface of the garment for stitching the garment and a feed means engages a bottom surface of the garment for feeding the garment through the stitch-forming means when the stitch-forming means is disengaged from the garment, comprising:

puller means downstream of the feed means for uniformly pulling the garment in synchronization with the feed means when the stitch-forming means is disengaged from the garment;

drive means for driving the feed means and the puller means in synchronization with the stitch-forming means, intermittently engaging said puller means for advancing the garment when the stitch-forming means is disengaged from the top surface of the garment and intermittently disengaging said puller means when the stitch-forming means is engaged with the top surface of the garment;

first and second engagement means positioned substantially above said puller means for engaging the top surface of the garment as the feed means and said puller means engage the bottom surface of the garment; and first and second control means operatively connected to said first and second engagement means for selectively and independently moving said first and second engagement means into and out of engagement with the top surface of the garment.

15. The puller device of claim 14, wherein said puller device pulls the garment downstream of the stitch-forming means so that excess thread may be cut from the garment.

16. The puller device of claim 14, wherein said feed means comprises a feed dog.

17. The puller device of claim 14, wherein said puller means comprises a roller having a serrated peripheral surface.

18. The puller device of claim 14, wherein said puller means is attached externally of the sewing machine.

19. The puller device of claim 14, whereto said drive means is clampingly attached to said feed means.

20. The puller device of claim 14, wherein said drive means comprises a feed rocker shaft.

21. The puller device of claim 14, wherein said first and second engagement means comprise first and second presser feet, respectively.

22. The puller device of claim 14, wherein said first and second control means comprise first and second pneumatic cylinders, respectively.

23. The puller device of claim 14, wherein said first and second control means are laterally adjustable to further accommodate said first and second adjacent portions, at least one of which has multiple layers.

* * * * *